US006012015A

United States Patent [19]

Tubel

[11] Patent Number: 6,012,015

[45] Date of Patent: Jan. 4, 2000

[54] CONTROL MODEL FOR PRODUCTION WELLS

[75] Inventor: Paulo Tubel, The Woodlands, Tex.

[73] Assignee: Baker Hughes Incorporated, Houston, Tex.

[21] Appl. No.: 08/932,492

[22] Filed: Sep. 18, 1997

Related U.S. Application Data

[63] Continuation-in-part of application No. 08/386,504, Feb. 9, 1995, Pat. No. 5,706,896.

[60] Provisional application No. 60/026,785, Sep. 23, 1996.

[51] Int. Cl.[7] ..... G06F 19/00

[52] U.S. Cl. ..... 702/6

[58] Field of Search ..... 702/6, 9; 166/53; 175/45

[56] References Cited

U.S. PATENT DOCUMENTS

| | | |
|---|---|---|
| Re. 32,463 | 7/1987 | Westlake et al. . |
| Re. 33,690 | 9/1991 | Adams, Jr. et al. . |
| Re. 34,111 | 10/1992 | Wynn . |
| 3,219,107 | 11/1965 | Brown, Jr. et al. . |
| 3,224,267 | 12/1965 | Harlan et al. . |
| 3,357,490 | 12/1967 | Holmes . |
| 3,629,859 | 12/1971 | Copland et al. . |
| 3,665,955 | 5/1972 | Conner, Sr. . |
| 3,697,952 | 10/1972 | Hayre . |
| 3,731,742 | 5/1973 | Sizer et al. . |
| 4,125,163 | 11/1978 | Fitzpatrick . |
| 4,150,721 | 4/1979 | Norwood . |
| 4,337,653 | 7/1982 | Chauffe . |
| 4,413,676 | 11/1983 | Kervin . |
| 4,581,613 | 4/1986 | Ward et al. . |
| 4,616,700 | 10/1986 | Wood et al. . |
| 4,617,960 | 10/1986 | More . |
| 4,622,635 | 11/1986 | Chandra et al. . |
| 4,633,954 | 1/1987 | Dixon et al. . |
| 4,636,934 | 1/1987 | Schwendemann et al. . |
| 4,664,602 | 5/1987 | Gordon . |
| 4,685,522 | 8/1987 | Dixon et al. . |
| 4,712,613 | 12/1987 | Nieuwstad . |
| 4,757,314 | 7/1988 | Aubin et al. . |
| 4,788,545 | 11/1988 | Farque . |
| 4,790,380 | 12/1988 | Ireland et al. . |
| 4,796,699 | 1/1989 | Upchurch . |
| 4,806,928 | 2/1989 | Veneruso . |
| 4,856,595 | 8/1989 | Upchurch . |
| 4,886,126 | 12/1989 | Yates, Jr. . |
| 4,896,722 | 1/1990 | Upchurch . |
| 4,921,048 | 5/1990 | Crow et al. . |
| 4,922,423 | 5/1990 | Koomey et al. . |
| 4,971,160 | 11/1990 | Upchurch . |
| 4,981,173 | 1/1991 | Perkins et al. . |
| 4,989,671 | 2/1991 | Lamp . |
| 5,008,664 | 4/1991 | More et al. . |
| 5,050,675 | 9/1991 | Upchurch . |
| 5,127,477 | 7/1992 | Schultz . |
| 5,132,904 | 7/1992 | Lamp . |
| 5,134,471 | 7/1992 | Gendron et al. . |
| 5,147,559 | 9/1992 | Brophey et al. . |

(List continued on next page.)

*Primary Examiner*—Donald E. McElheny, Jr.
*Attorney, Agent, or Firm*—Cantor Colburn LLP

[57] ABSTRACT

A downhole production well control system is provided for automatically controlling downhole tools in response to sensed selected downhole parameters. The production well having a production tubing string therein with multiple branches, i.e., zones, each including a downhole control system. Each control system includes electromechanical drivers and devices to control fluid flow. The downhole control systems collect and analyze data from multiple sensors to determine what (if any) actions should be taken in response to sensor stimuli. The actions taken will be based on rules, learned behavior and input from downhole external sources. Well operation and downhole tool models are embedded in the control computer, as are methods to evaluate the models to determine the present and future optimum operating conditions for the well. This network of intelligent control systems in a borehole has to interact to determine the optimum production parameters for the entire borehole; not just a single zone. Production parameters that may create an ideal production rate for one zone may have an adverse effect on the other zones.

22 Claims, 8 Drawing Sheets

U.S. PATENT DOCUMENTS 5,172,717 12/1992 Boyle et al. .
5,188,183 2/1993 Hopmann et al. .
5,191,937 3/1993 Cook, Sr. .
5,220,963 6/1993 Patton .
5,226,494 7/1993 Rubbo et al. .
5,234,057 8/1993 Schultz et al. .
5,265,677 11/1993 Schultz .
5,273,112 12/1993 Schultz .
5,273,113 12/1993 Schultz .
5,279,363 1/1994 Schultz et al. .
5,293,551 3/1994 Perkins et al. .
5,318,130 6/1994 Manke .
5,332,035 7/1994 Schultz et al. .
5,332,048 7/1994 Underwood et al. .
5,343,963 9/1994 Bouldin et al. .
5,358,035 10/1994 Grudzinski .
5,387,907 2/1995 Gardner et al. .
5,517,593 5/1996 Nenniger et al. .
5,526,880 6/1996 Jordan, Jr. et al. .
5,531,270 7/1996 Fletcher et al. .
5,706,896 1/1998 Tubel et al. ..... 166/313
5,812,068 9/1998 Wisler et al. ..... 340/855.5
5,842,149 11/1998 Harrell et al. ..... 702/9

CONTROL MODEL FOR PRODUCTION WELLS

CROSS-REFERENCE TO RELATED APPLICATIONS

This application is a continuation-in-part of U.S. patent application Ser. No. 08/386,504 filed Feb. 9, 1995 now U.S. Pat. No. 5,706,896, and claims the benefit of U.S. Provisional Application Serial No. 60/026,785 filed Sep. 23, 1996.

BACKGROUND OF THE INVENTION

1. Field of the Invention

This invention relates generally to a method and apparatus for the control of oil and gas production wells. More particularly, this invention relates to a method and apparatus for automatically controlling petroleum production wells downhole using modeling techniques.

2. The Prior Art

The control of oil and gas production wells constitutes an on-going concern of the petroleum industry due, in part, to the enormous monetary expense involved as well as the risks associated with environmental and safety issues.

Production well control has become particularly important and more complex in view of the industry wide recognition that wells having multiple branches (i.e., multilateral wells) will be increasingly important and commonplace. Such multilateral wells include discrete production zones which produce fluid in either common or discrete production tubing. In either case, there is a need for controlling zone production, isolating specific zones and otherwise monitoring each zone in a particular well.

Before describing the current state-of-the-art relative to such production well control systems and methods, a brief description will be made of the production systems, per se, in need of control. One type of production system utilizes electrical submersible pumps (ESP) for pumping fluids from downhole. In addition, there are two other general types of productions systems for oil and gas wells, namely plunger lift and gas lift. Plunger lift production systems include the use of a small cylindrical plunger which travels through tubing extending from a location adjacent the producing formation down in the borehole to surface equipment located at the open end of the borehole. In general, fluids which collect in the borehole and inhibit the flow of fluids out of the formation and into the wellbore, are collected in the tubing. Periodically, the end of the tubing is opened at the surface and the accumulated reservoir pressure is sufficient to force the plunger up the tubing. The plunger carries with it to the surface a load of accumulated fluids which are ejected out the top of the well thereby allowing gas to flow more freely from the formation into the wellbore and be delivered to a distribution system at the surface. After the flow of gas has again become restricted due to the further accumulation of fluids downhole, a valve in the tubing at the surface of the well is closed so that the plunger then falls back down the tubing and is ready to lift another load of fluids to the surface upon the reopening of the valve.

A gas lift production system includes a valve system for controlling the injection of pressurized gas from a source external to the well, such as another gas well or a compressor, into the borehole. The increased pressure from the injected gas forces accumulated formation fluids up a central tubing extending along the borehole to remove the fluids and restore the free flow of gas and/or oil from the formation into the well. In wells where liquid fall back is a problem during gas lift, plunger lift may be combined with gas lift to improve efficiency.

In both plunger lift and gas lift production systems, there is a requirement for the periodic operation of a motor valve at the surface of the wellhead to control either the flow of fluids from the well or the flow of injection gas into the well to assist in the production of gas and liquids from the well. These motor valves are conventionally controlled by timing mechanisms and are programmed in accordance with principles of reservoir engineering which determine the length of time that a well should be either "shut in" and restricted from the flowing of gas or liquids to the surface and the time the well should be "opened" to freely produce. Generally, the criteria used for operation of the motor valve is strictly one of the elapse of a preselected time period. In most cases, measured well parameters, such as pressure, temperature, etc. are used only to override the timing cycle in special conditions.

It will be appreciated that relatively simple, timed intermittent operation of motor valves and the like is often not adequate to control either outflow from the well or gas injection to the well so as to optimize well production. As a consequence, sophisticated computerized controllers have been positioned at the surface of production wells for control of downhole devices such as the motor valves.

In addition, such computerized controllers have been used to control other downhole devices such as hydro-mechanical safety valves. These typically microprocessor based controllers are also used for zone control within a well and, for example, can be used to actuate sliding sleeves or packers by the transmission of a surface command to downhole microprocessor controllers and/or electromechanical control devices.

The surface controllers are often hardwired to downhole sensors which transmit information to the surface such as pressure, temperature and flow. This data is then processed at the surface by the computerized control system. Electrically submersible pumps use pressure and temperature readings received at the surface from downhole sensors to change the speed of the pump in the borehole. As an alternative to downhole sensors, wire line production logging tools are also used to provide downhole data on pressure, temperature, flow, gamma ray and pulse neutron using a wire line surface unit. This data is then used for control of the production well.

There are numerous prior art patents related to the control of oil and gas production wells. In general, these prior patents relate to (1) surface control systems using a surface microprocessor and (2) downhole control systems which are initiated by surface control signals.

The surface control system patents generally disclose computerized systems for monitoring and controlling a gas/oil production well whereby the control electronics is located at the surface and communicates with sensors and electromechanical devices near the surface. An example of a system of this type is described in U.S. Pat. No. 4,633,954 ('954) to Dixon et al. The system described in the '954 patent includes a fully programmable microprocessor controller which monitors downhole parameters such as pressure and flow and controls the operation of gas injection to the well, outflow of fluids from the well or shutting in of the well to maximize output of the well. This particular system includes battery powered solid state circuitry comprising a keyboard, a programmable memory, a microprocessor, control circuitry and a liquid crystal display. Another example of a control system of this type is described in U.S. Pat. No. 5,132,904 ('904) to Lamp. The '904 patent discloses a system similar to the '954 patent and in addition also describes a feature wherein the controller includes serial and parallel communication ports through which all communications to and from the controller pass. Hand held devices or portable computers capable of serial communication may access the controller. A telephone modem or telemetry link to a central host computer may also be used to permit several controllers to be accessed remotely.

U.S. Pat. No. 4,757,314 ('314) to Aubin et al describes an apparatus for controlling and monitoring a well head submerged in water. This system includes a plurality of sensors, a plurality of electromechanical valves and an electronic control system which communicates with the sensors and valves. The electronic control system is positioned in a water tight enclosure and the water tight enclosure is submerged underwater. The electronics located in the submerged enclosure control and operate the electromechanical valves based on input from the sensors. In particular, the electronics in the enclosure uses the decision making abilities of the microprocessor to monitor the cable integrity from the surface to the well head to automatically open or close the valves should a break in the line occur.

The downhole control system patents generally disclose downhole microprocessor controllers, electromechanical control devices and sensors. Examples include U.S. Pat. Nos. 4,915,168 ('168) to Upchurch and 5,273,112 ('112) to Schultz. However, in each and every case, the microprocessor controllers transmit control signals only upon actuation from a surface or other external control signal. There is no teaching in any of these patents that the downhole microprocessor controllers themselves may automatically initiate the control of the electromechanical devices based on preprogrammed instructions. Similarly, none of the aforementioned patents directed to microprocessor based control systems for controlling the production from oil and gas wells, including the aforementioned '954, '904 and '314 patents, disclose the use of downhole electronic controllers, electromechanical control devices and sensors whereby the electronic control units will automatically control the electromechanical devices based on input from the sensor without the need for a surface or other external control signal.

It will be appreciated that the downhole control system of the types disclosed in the '168 and '112 patents are closely analogous to the surface based control systems such as disclosed in the '954, '904 and '314 patents in that a surface controller is required at each well to initiate and transmit the control instructions to the downhole microprocessor. Thus, in all cases, some type of surface controller and associated support platform at each well is needed.

While it is well recognized that petroleum production wells will have increased production efficiencies and lower operating costs if surface computer based controllers and downhole microprocessor controller (actuated by external or surface signals) of the type discussed hereinabove are used, the presently implemented control systems nevertheless suffer from drawbacks and disadvantages. For example, as mentioned, all of these prior art systems generally require a surface platform at each well for supporting the control electronics and associated equipment. However, in many instances, the well operator would rather forego building and maintaining the costly platform. Thus, a problem is encountered in that use of present surface controllers require the presence of a location for the control system, namely the platform. Still another problem associated with known surface control systems such as the type disclosed in the '168 and '112 patents wherein a downhole microprocessor is actuated by a surface signal is the reliability of surface to downhole signal integrity. It will be appreciated that should the surface signal be in any way compromised on its way downhole, then important control operations (such as preventing water from flowing into the production tubing) will not take place as needed.

In multilateral wells where multiple zones are controlled by a single surface control system, an inherent risk is that if the surface control system fails or otherwise shuts down, then all of the downhole tools and other production equipment in each separate zone will similarly shut down leading to a large loss in production and, of course, a loss in revenue.

Still another significant drawback of present production well control systems involves the extremely high cost associated with implementing changes in well control and related workover operations. Presently, if a problem is detected at the well, the customer is required to send a rig to the well site at an extremely high cost (e.g., 5 million dollars for 30 days of offshore work). The well must then be shut in during the workover causing a large loss in revenues (e.g., 1.5 million dollars for a 30 day period). Associated with these high costs are the relatively high risks of adverse environmental impact due to spills and other accidents as well as potential liability of personnel at the rig site. Of course, these risks can lead to even further costs. Because of the high costs and risks involved, in general, a customer may delay important and necessary workover of a single well until other wells in that area encounter problems. This delay may cause the production of the well to decrease or be shut in until the rig is brought in.

Still other problems associated with present production well control systems involve the need for wireline formation evaluation to sense changes in the formation and fluid composition. Unfortunately, such wireline formation evaluation is extremely expensive and time consuming. In addition, it requires shut-in of the well and does not provide "real time" information. The need for real time information regarding the formation and fluid is especially acute in evaluating undesirable water flow into the production fluids.

SUMMARY OF THE INVENTION

The above-discussed and other problems and deficiencies of the prior art are overcome or alleviated by the production well control system of the present invention. In accordance with the present invention, a downhole production well control system is provided for automatically controlling downhole tools in accordance with a modeling technique utilizing sensed selected downhole parameters. It is important that the automatic control is initiated downhole without an initial control signal from the surface or from some other external source.

The present invention generally comprises downhole sensors and downhole electromechanical devices and having downhole computerized control electronics associated therewith. The downhole computer or processor employing modeling techniques for automatically controlling the downhole electromechanical devices based on input from the downhole sensors. Thus, using the downhole sensors, the downhole computerized control system will monitor actual downhole parameters (such as pressure, temperature, flow, gas influx, etc.) and automatically execute control instructions in accordance with the model. The automatic control instructions will then cause an electromechanical control device (such as a valve) to actuate a suitable tool (for example, actuate a sliding sleeve or packer; or close a pump or other fluid flow device).

The downhole control system of this invention may include transceivers for two-way communication with the surface as well as a telemetry device for communicating from the surface of the production well to a remote location.

The downhole control system is preferably located in each zone of a well such that a plurality of wells associated with one or more platforms will have a plurality of downhole control systems, one for each zone in each well. The downhole control systems have the ability to communicate with other downhole control systems in other zones in the same or different wells. In addition, each downhole control system in a zone may also communicate with a surface control system. The downhole control system of this invention thus is extremely well suited for use in connection with multilateral wells which include multiple zones. The processors of each control system are preferably in communication with each other, whereby parallel or multi-task processing techniques can be employed to maximize processing power downhole. Alternatively, a main or central processor can be located downhole to communicate with the processors of the control systems, e.g., employing a master/slave configuration.

A power source provides energy to the downhole control system. Power for the power source can be generated in the borehole (e.g., by a turbine generator), at the surface or be supplied by energy storage devices such as batteries (or a combination of one or more of these power sources). The power source provides electrical voltage and current to the downhole electronics, electromechanical devices and sensors in the borehole.

In contrast to the aforementioned prior art well control systems which consist either of computer systems located wholly at the surface or downhole computer systems which require an external (e.g., surface) initiation signal (as well as a surface control system), the downhole well production control system of this invention automatically operates based on downhole conditions sensed in real time without the need for a surface or other external signal. This important feature constitutes a significant advance in the field of production well control. For example, use of the downhole control system of this invention obviates the need for a surface platform. The downhole control system of this invention is also inherently more reliable since no surface to downhole actuation signal is required and the associated risk that such an actuation signal will be compromised is therefore rendered moot. With regard to multilateral (i.e., multi-zone) wells, still another advantage of this invention is that, because the entire production well and its multiple zones are not controlled by a single surface controller, then the risk that an entire well including all of its discrete production zones will be shut-in simultaneously is greatly reduced.

The downhole control systems are associated with permanent downhole formation evaluation sensors which remain downhole throughout production operations. These formation evaluation sensors for formation measurements may include, for example, gamma ray detection for formation evaluation, neutron porosity, resistivity, acoustic sensors and pulse neutron which can, in real time, sense and evaluate formation parameters including important information regarding water migrating from different zones. Significantly, this information can be obtained prior to the water actually entering the producing tubing and therefore corrective action (i.e., closing of a valve or sliding sleeve) or formation treatment can be taken prior to water being produced. This real time acquisition of formation data in the production well constitutes an important advance over current wireline techniques in that the present invention is far less costly and can anticipate and react to potential problems before they occur. In addition, the formation evaluation sensors themselves can be placed much closer to the actual formation (i.e., adjacent the casing or downhole completion tool) then wireline devices which are restricted to the interior of the production tubing.

The complex downhole processing capabilities required by the present invention, require highly intelligent downhole control systems which will learn to detect and adapt to changes in process parameters. The control systems have to react to stimuli from the zone under their direct control, as well as, proposed actions from other intelligent control systems in different zones that would impact their zone. This network of intelligent control systems in a borehole has to interact to determine the optimum production parameters for the entire borehole; not just a single zone. Production parameters that may create an ideal production rate for one zone may have an adverse effect on the other zones.

The downhole control systems collect and analyze data from multiple sensors to determine what (if any) actions should be taken in response to sensor stimuli. The actions taken will be based on rules, learned behavior and input from downhole external sources.

Well operation and downhole tool models are embedded in the control computer, as are methods to evaluate the models to determine the present and future optimum operating conditions for the well. Optimum conditions are specified by flexible, objective functions that are preferably stored in the memory associated with the computer downhole. The models contained therein are adaptive in that their form or mathematical representation, as well as the parameters associated with any given model, can change as required. These models include, but are not limited to first principles and phenomenological models, as well as all classes of empirical models that include neural network representations and other state space approaches. Optimization is accomplished by combining the contained knowledge of the process and machine through these models with expert system rules about the same. These rules embody operational facts and heuristic knowledge about the production well and the process of operating the production. The rule system can embody both crisp and fuzzy representations and combine all feed forward, feedback, and model representations of the well and process to maintain stable, safe, and also optimal operation, including the machine and the process. Determination of the optimum operating states includes evaluating the model representation of the machine and process. This is done by combination of the expert system rules and models in conjunction with the objective functions. Genetic algorithms and other optimization methods are used to evaluate the models to determine the best possible operating conditions at any point in time. These methods are combined in such a way that the combined control approach changes and learns over time and adapts to improve performance with regard to the well and the process performance thereof.

The above-discussed and other features and advantages of the present invention will be appreciated by and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

A downhole production well control system is provided for automatically controlling downhole tools in accordance with a modeling technique utilizing sensed selected downhole parameters. It is important that the automatic control is initiated downhole without an initial control signal from the surface or from some other external source.

The present invention generally comprises downhole sensors and downhole electromechanical devices or modules having downhole computerized control electronics associated therewith, such as described in U.S. patent application Ser. No. 08/385,992, filed Feb. 9, 1995, U.S. Pat. No. 5,732,776, entitled Downhole Production Well Control System and Method, by Tubel et al., which is expressly incorporated herein by reference. Each downhole computerized control electronics having a downhole computer or processor which employs modeling techniques for automatically controlling the downhole electromechanical devices based on input from the downhole sensors. Thus, using the downhole sensors, the downhole computerized control system will monitor actual downhole parameters (such as pressure, temperature, flow, gas influx, etc.) and automatically execute control instructions in accordance with the model to optimize production in the well.

As is known, a given well may be divided into a plurality of separate zones which are required to isolate specific areas of a well for purposes of producing selected fluids, preventing blowouts and preventing water intake. Such zones may be positioned in a single vertical well such as well 19 associated with platform 2 shown in FIG. 1 or such zones can result when multiple wells are linked or otherwise joined together. A particularly significant contemporary feature of well production is the drilling and completion of lateral or branch wells which extend from a particular primary wellbore. These lateral or branch wells can be completed such that each lateral well constitutes a separable zone and can be isolated for selected production. A more complete description of well bores containing one or more laterals (known as multilaterals) can be found in U.S. Pat. Nos. 4,807,407, 5,325,924 and 5,411,082 ('082), all of the contents of each of those patents and applications being incorporated herein by reference.

Figure 1:
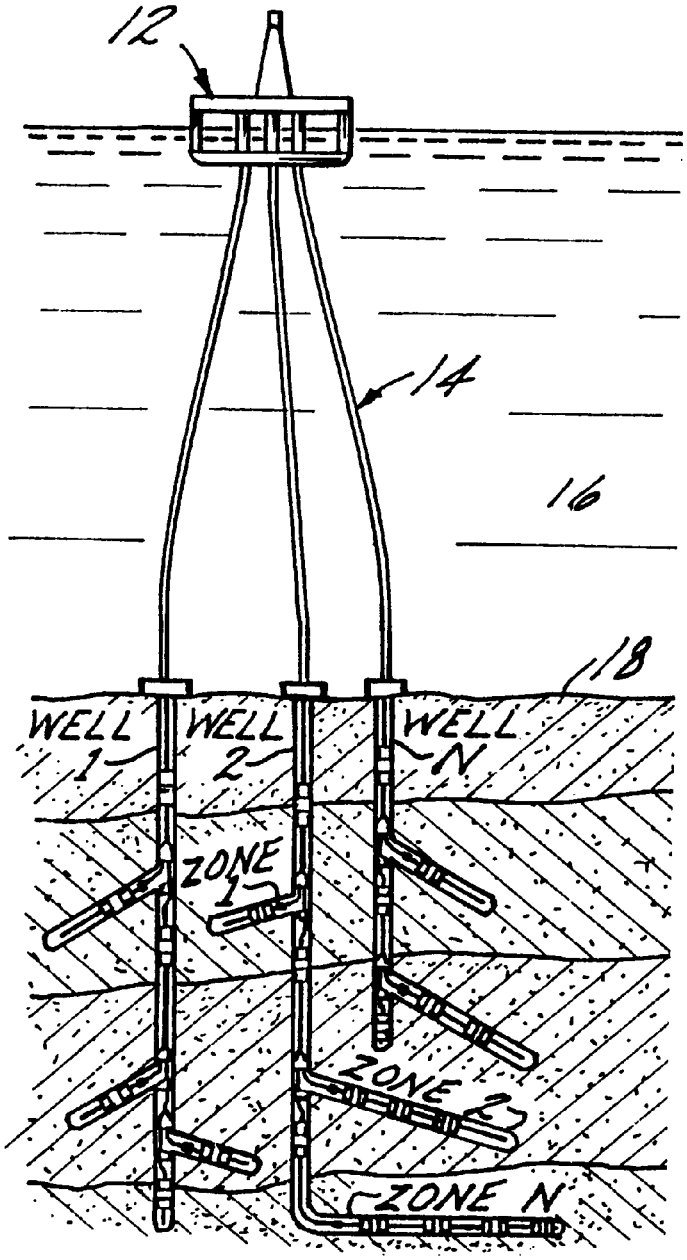
FIG. 1 is a diagrammatic view depicting the control system of the present invention for use in controlling a well.
Figure 2:
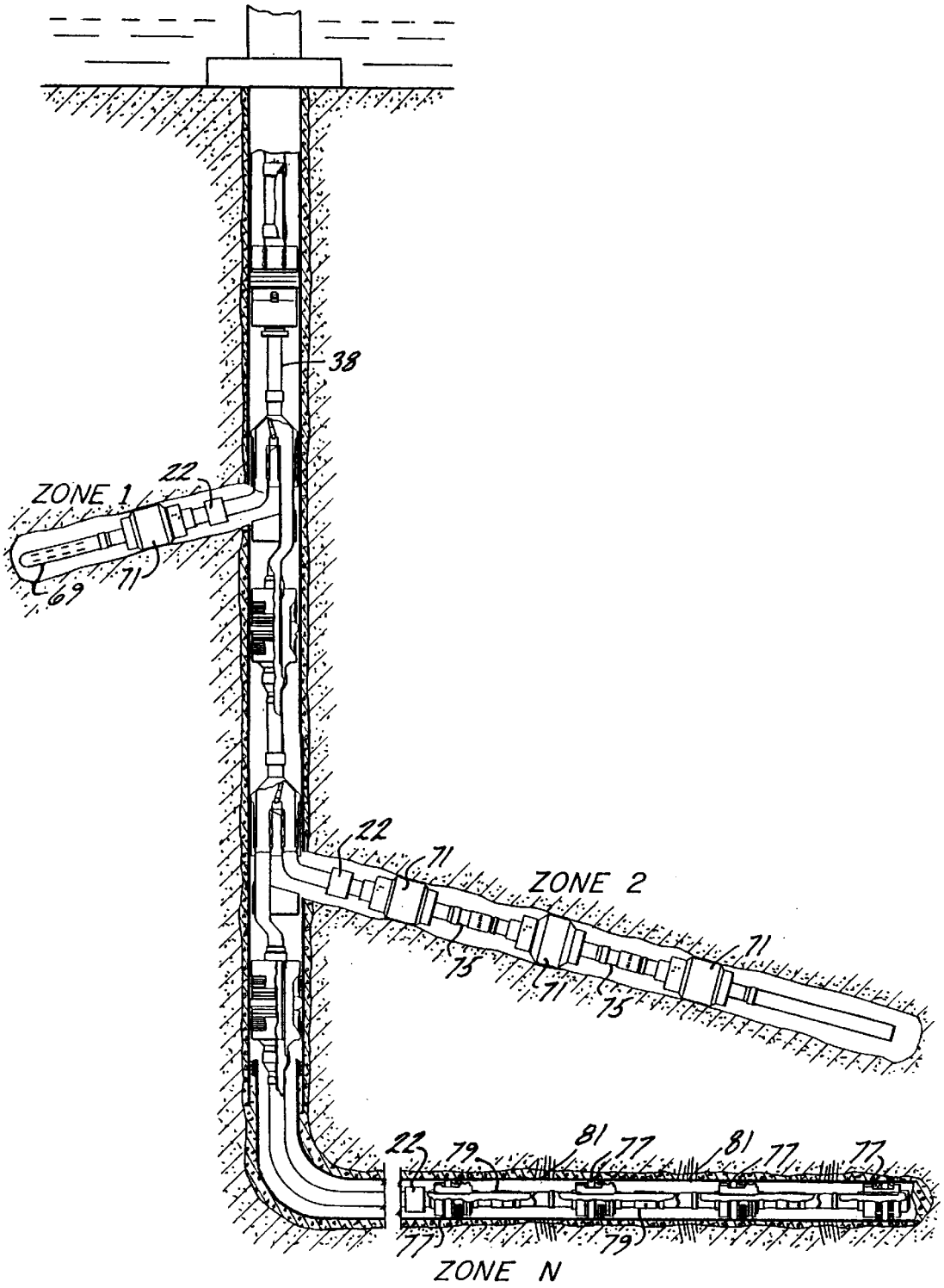
FIG. 2 is an enlarged diagrammatic view of a portion of the well of FIG. 1 depicting selected zones in the well and a downhole control system for use therewith.
Figure 3:
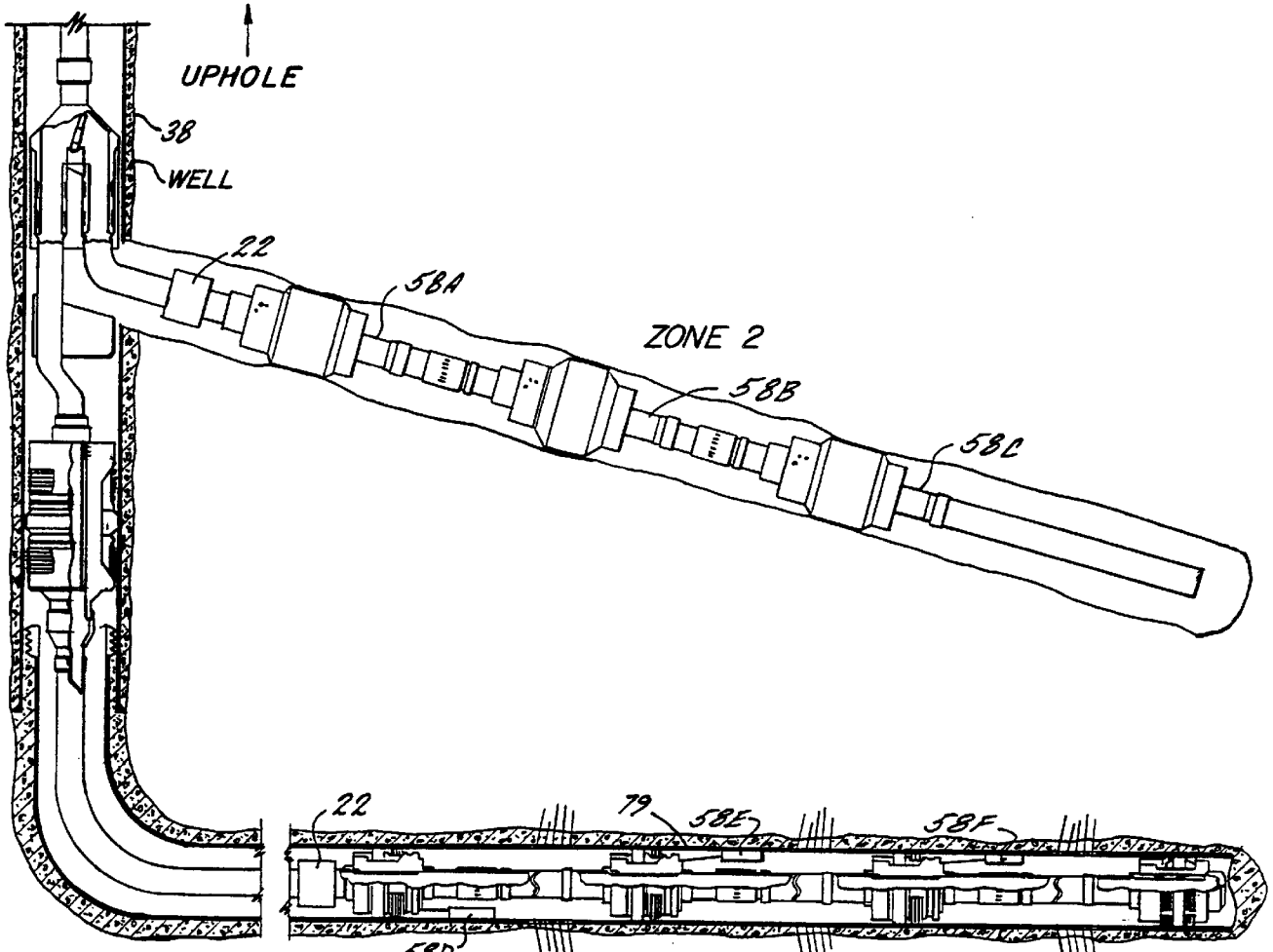
FIG. 3 is an enlarged diagrammatic view of a portion of FIG. 2 depicting control systems for both open hole and cased hole completion zones.

With reference to FIGS. 1–3, a well includes a plurality of zones which need to be monitored and/or controlled for efficient production and management of the well fluids. For example, with reference to FIG. 2, well number 2 includes three zones, namely zone number 1, zone number 2 and zone number N. Each of zones 1, 2 and N have been completed in a known manner; and more particularly have been completed in the manner disclosed in aforementioned '082 patent. In zone 1, a slotted liner completion is shown at 69 associated with a packer 71. In zone 2, an open hole completion is shown with a series of packers 73 and intermittent sliding sleeves 75. In zone N, a cased hole completion is shown again with the series of packers 77, sliding sleeve 79 and perforating tools 81. Associated with each of zones 1, 2 and N is a downhole control system 22. The control system 22 in zone 1 includes electromechanical drivers and electromechanical devices which control the packers 69 and valving associated with the slotted liner so as to control fluid flow. Similarly, control system 22 in zone 2 include electromechanical drivers and electromechanical devices which control the packers, sliding sleeves and valves associated with that open hole completion system. The control system 22 in zone N also includes electromechanical drivers and electromechanical control devices for controlling the packers, sliding sleeves and perforating equipment depicted therein.

Figure 4:
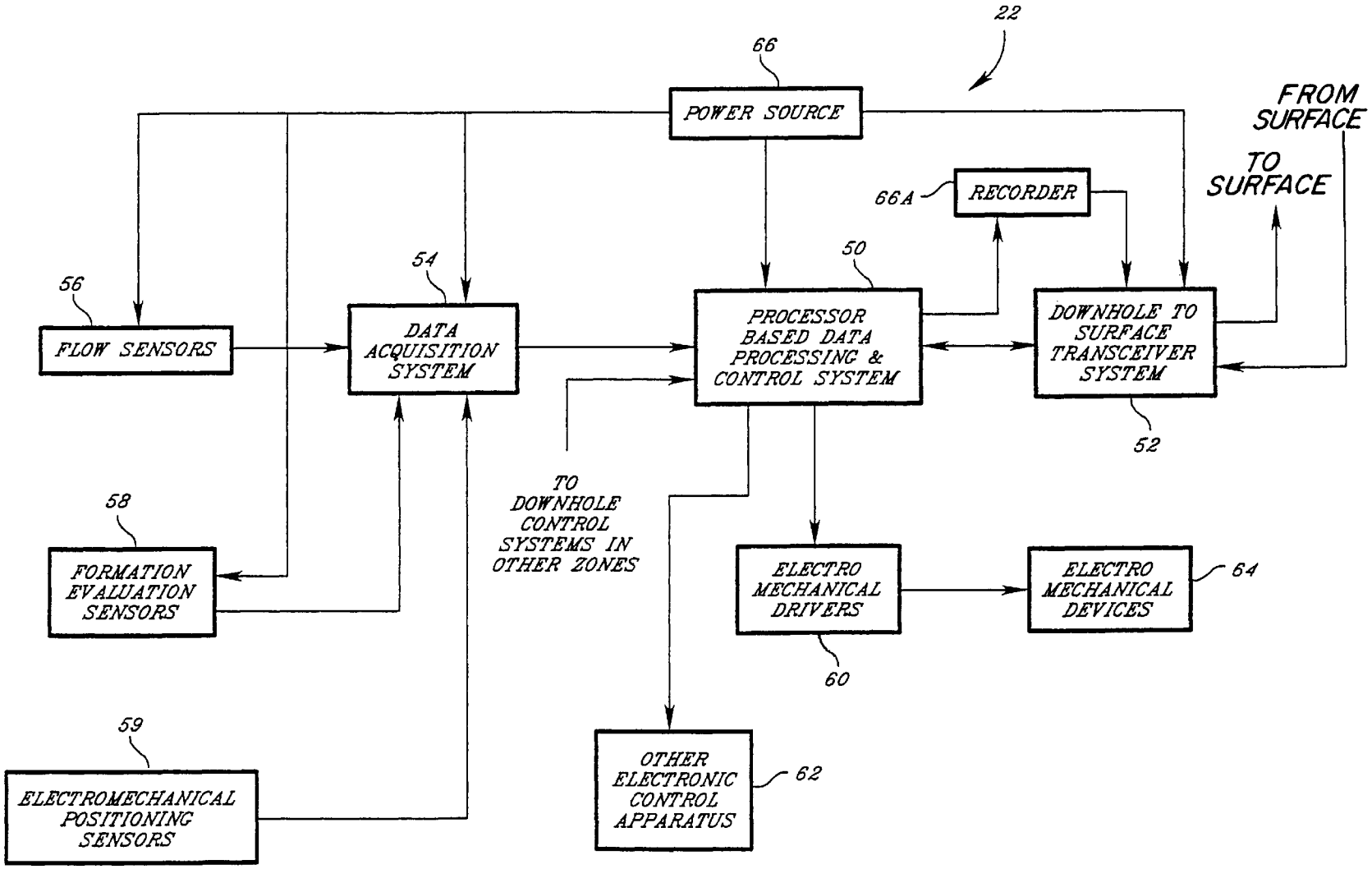
FIG. 4 is a block diagram depicting a downhole production well control system in accordance with the present invention.
Figure 5:
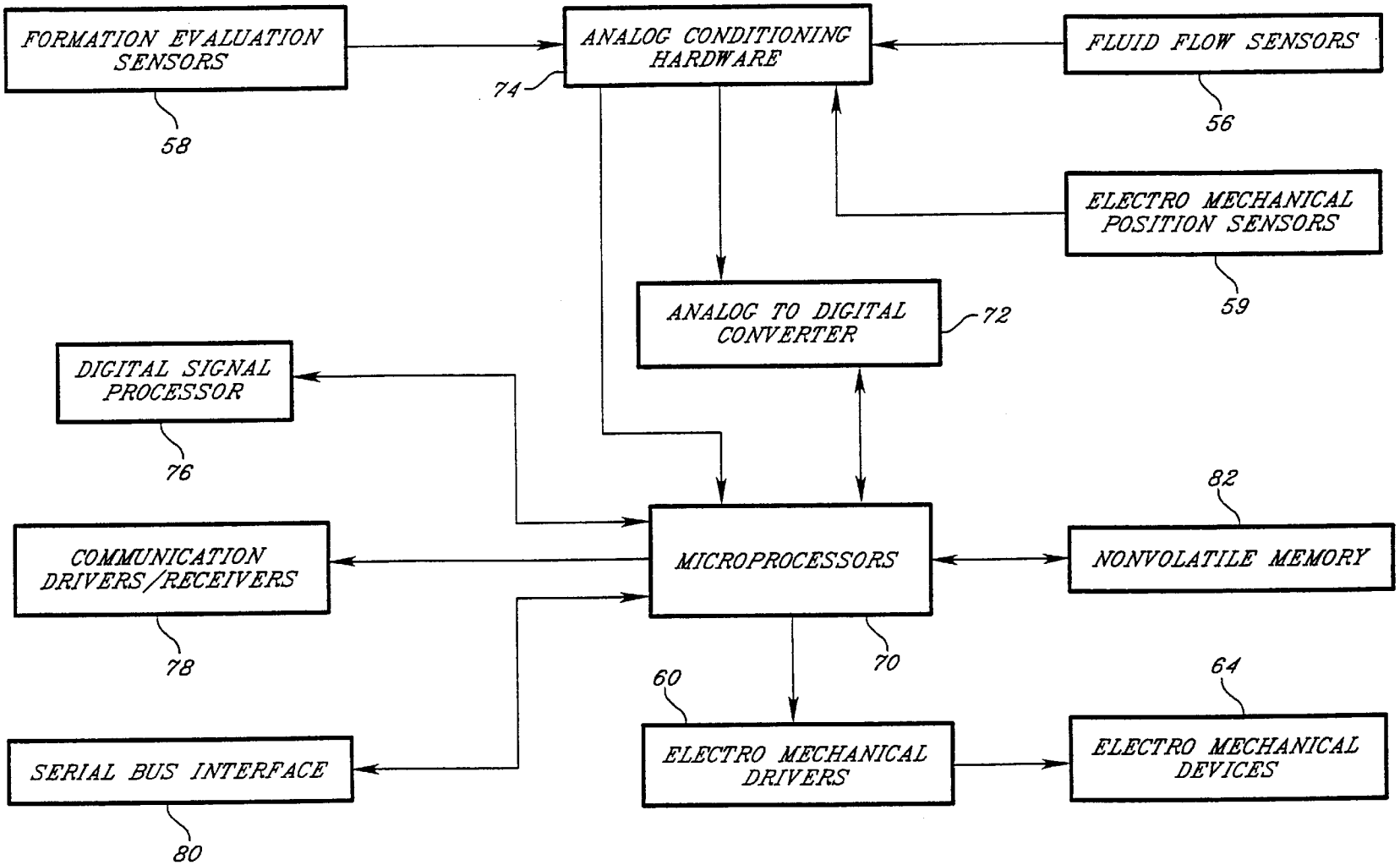
FIG. 5 is an electrical schematic of the downhole production well control system of FIG. 4.

Referring to FIGS. 4 and 5, control computer (controller) 50 processes downhole sensor information as received from the data acquisition system 54. Data acquisition system 54 will preprocess the analog and digital sensor data by sampling the data periodically and formatting it for transfer to control computer 50. Included among this data is data from flow sensors 56, formation evaluation sensors 58 and electromechanical position sensor 59 (these latter sensors 59 provide information on position, orientation and the like of downhole tools). The formation evaluation data is processed for the determination of reservoir parameters related to the well production zone being monitored by the downhole control module. The flow sensor data is processed and evaluated against parameters stored in the downhole module's memory to determine if a condition exists which requires the intervention of the control computer 50 to automatically control the electromechanical devices. It will be appreciated that in accordance with an important feature of this invention, the automatic control executed by control computer 50 is initiated without the need for a initiation or control signal from the surface or from some other external source. Instead, the processor 50 simply evaluates parameters existing in real time in the borehole as sensed by flow sensors 56 and/or formation evaluations sensors 58 and then automatically executes instructions for appropriate control. Note that while such automatic initiation is an important feature of this invention, in certain situations, an operator from the surface may initiate or stop the fluid/gas flow from the geological formation into the borehole or from the borehole to the surface, e.g., an emergency override function.

The downhole sensors associated with flow sensors 56 and formation evaluations sensors 58 may include, but are not limited to, sensors for sensing pressure, flow, temperature, oil/water content, geological formation, gamma ray detectors and formation evaluation sensors which utilize acoustic, nuclear, resistivity and electromagnetic technology. It will be appreciated that typically, the pressure, flow, temperature and fluid/gas content sensors will be used for monitoring the production of hydrocarbons while the formation evaluation sensors will measure, among other things, the movement of hydrocarbons and water in the formation. The downhole control computer 50 automatically executes instructions for actuating electromechanical drivers 60 or other electronic control apparatus 62. In turn, the electromechanical driver 60 will actuate an electromechanical device for controlling a downhole tool such as a sliding sleeve, shut off device, valve, variable choke, penetrator, perf valve or gas lift tool. As mentioned, downhole control computer 50 may also control other electronic control apparatus such as apparatus that may effect flow characteristics of the fluids in the well.

In addition, downhole control computer 50 is capable of recording downhole data acquired by flow sensors 56, formation evaluation sensors 58 and electromechanical position sensors 59. This downhole data is recorded in recorder 66. Information stored in recorder 66 may be retrieved to evaluate production performance.

It will be appreciated that the downhole control system 22 requires a power source 66 for operation of the system. Power source 66 can be generated in the borehole, at the surface or it can be supplied by energy storage devices such as batteries. Power is used to provide electrical voltage and current to the electronics and electromechanical devices connected to a particular sensor in the borehole. Power for the power source may come from the surface through hardwiring or may be provided in the borehole such as by using a turbine. Other power sources include chemical reactions, flow control, thermal, conventional batteries, borehole electrical potential differential, solids production or hydraulic power methods.

The complex downhole processing capabilities required by the present invention, require highly intelligent downhole control systems which will learn to detect and adapt to changes in process parameters. The control systems have to react to stimuli from the zone under their direct control, as well as, proposed actions from other intelligent control systems in different zones that would impact their zone. This network of intelligent control systems in a borehole has to interact to determine the optimum production parameters for the entire borehole; not just a single zone. Production parameters that may create an ideal production rate for one zone may have an adverse effect on the other zones.

The control systems are preferably multiprocessing, multitasking systems. The control systems collect data real time, as described hereinbefore, from the various sensors and adjust process control parameters as necessary. To this end, the control systems include a fault tolerant, high availability, real time operating system kernel and software capable of communicating with other control systems, interface with monitoring and control devices and making decision based on inputs from all of these sources. The program is preferably stored in nonvolatile, reprogrammable program memory 82 so it can be remotely or locally reprogrammed. The computer is capable of self modifying the operating firmware.) The computer includes a boot ROM to be used while reprogramming flash program memory.

The downhole control systems collect and analyze data from multiple sensors to determine what (if any) actions should be taken in response to sensor stimuli. The actions taken will be based on rules, learned behavior and input from downhole external sources.

Control system 22 preferably communicates through a standard communication protocol, e.g., Ethernet or RS-232. Control of the downhole tools includes controlling the mechanical state and operation thereof, and control of operating ranges to optimize safe as well as efficient operation. Such advanced, computerized control methods include but are not limited to neural networks, object oriented programming, genetic algorithms, fuzzy logic, expert systems, statistical analysis, signal processing, pattern recognition, categorical analysis, or a combination thereof.

Thus, in a preferred embodiment, this invention comprises at least one of these control methods and other methods more advanced than conventional, stabilizing control methods, for example, the simple feedback or feed forward control loops of the prior art. The response of the system is based on a series of expert rules, determined initially in advance and continually updated based upon the control system's own analysis of its performance. The control system will generate and continuously update its own "process model" using the sensor inputs described and the above-mentioned analysis techniques. The control system may have the ability to independently select the best analysis technique for the current data set.

While control computer 50 may operate using any one or more of a plurality of advanced computerized control methods, it is also contemplated that these methods may be combined with one or more of the prior art methods, including feed forward or feedback control loops. Feed forward is where process and machine measurements (or calculated, inferred, modeled variables normally considered ahead of the machine in the process) are used in the control system 22 to effectively control the operation of the production well.

Well operation and downhole tool models are embedded in control computer 50, as are methods to evaluate the models to determine the present and future optimum operating conditions for the well. Optimum conditions are specified by flexible, objective functions that are preferably stored in the memory associated with the computer downhole. The models contained therein are adaptive in that their form or mathematical representation, as well as the parameters associated with any given model, can change as required. These models include, but are not limited to first principles and phenomenological models, as well as all classes of empirical models that include neural network representations and other state space approaches. Optimization is accomplished by combining the contained knowledge of the process and machine through these models with expert system rules about the same. These rules embody operational facts and heuristic knowledge about the production well and the process of operating the production. The rule system can embody both crisp and fuzzy representations and combine all feed forward, feedback, and model representations of the well and process to maintain stable, safe, and also optimal operation, including the machine and the process. Determination of the optimum operating states includes evaluating the model representation of the machine and process. This is done by combination of the expert system rules and models in conjunction with the objective functions. Genetic algorithms and other optimization methods are used to evaluate the models to determine the best possible operating conditions at any point in time. These methods are combined in such a way that the combined control approach changes and learns over time and adapts to improve performance with regard to the well and the process performance thereof.

As discussed above, the adaptive control system of this invention uses one or a combination of internal and/or external machine and/or process variables to characterize or control the performance of the production well, in terms of the desired outputs (objects). Preferably, the control system continually updates its knowledge of the process, so that its control performance improves over time.

Figure 6A:
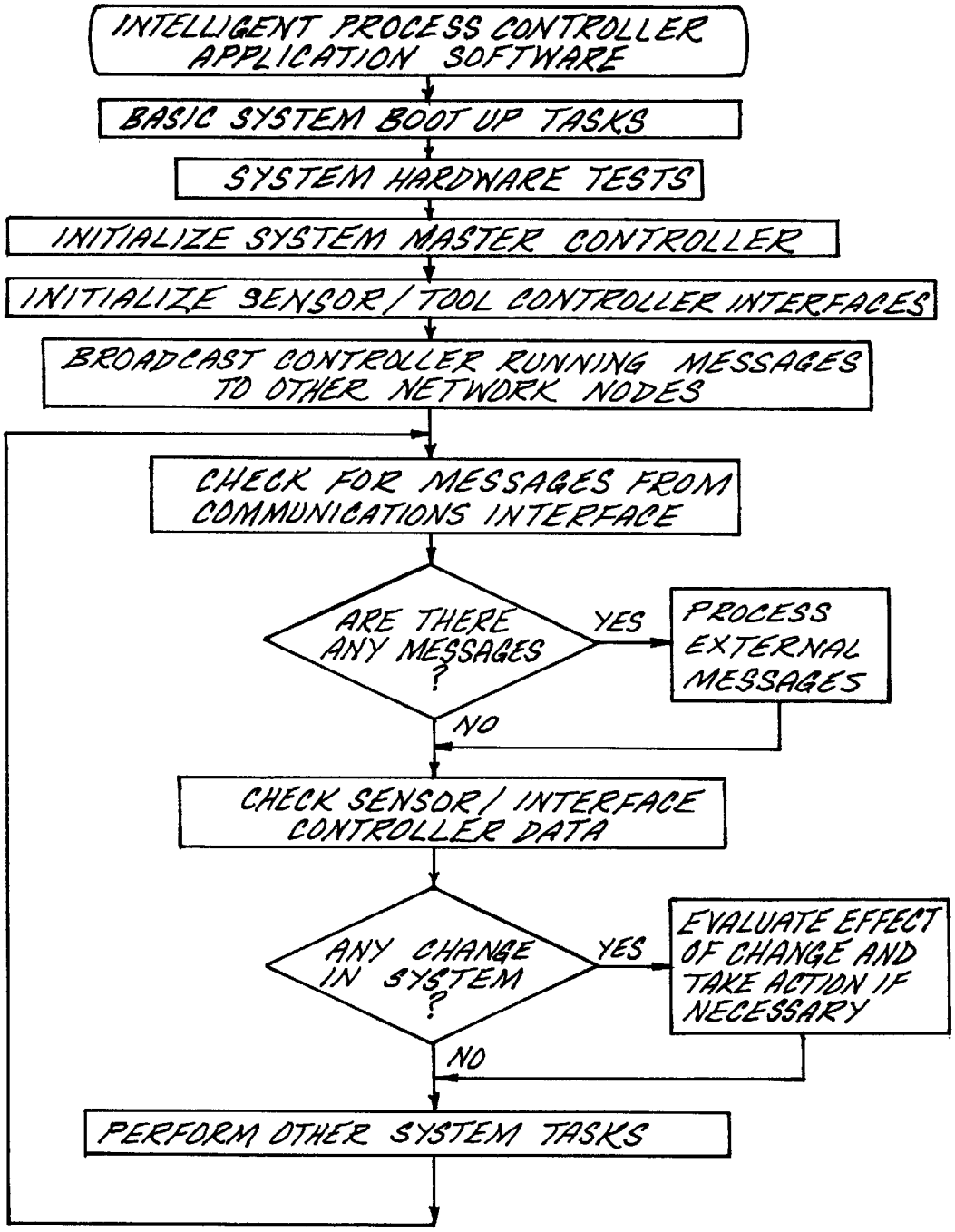
FIGS. 6A and B are a flow chart of initialization and operation of the control system of the present invention.
Figure 6B:
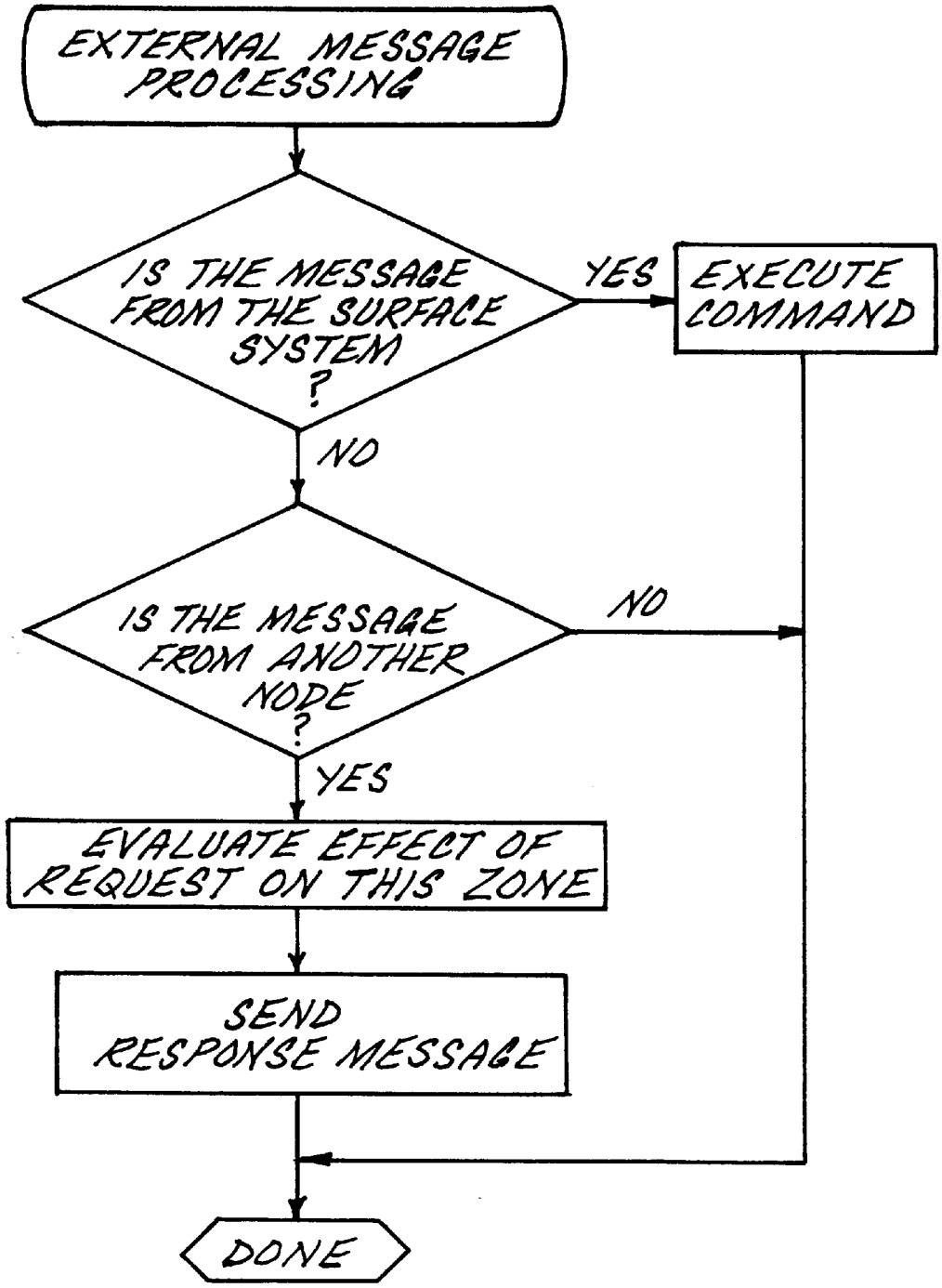

Referring to the flow charts of FIGS. 6A and B, the intelligent control systems of the present invention learn the range of proper operation for the different parameters monitored in the borehole, and maintain the zones in the wellbore being controlled by the systems at optimum production rate. By way of example, the following tasks can be performed by a downhole tool to assure that the parameters are at their proper operating range:

1. Monitor downhole pressure, and adjust range based on long term evaluation of the samples acquired and stored in the system's memory. The borehole pressure will decrease with time as the hydrocarbon is removed from the producing zone.
2. Monitor flow rates, and change the flow rate by choking the flow control device opening if the pressure goes above or below the correct operating range. If the pressure continues to stay outside the operating area, change the range to reflect the new borehole conditions. A safety pressure range can never be changed throughout the life of the well.
3. The hydrocarbons produced from the geological formation are replaced with water. The amount of water entering the hydrocarbon producing zones will determine how much oil and gas will be produced from the zones prior to 100 percent water production. The processing and evaluation of formation evaluation sensors for water saturation in the producing zones will allow the Intelligent Completion system to choke the flow control device to reduce the flow rate to assure that the maximum amount of hydrocarbon will be produced.
4. Flow rates will also change with time, and the control system will change the range of the flow rate to reflect the changes in the borehole.
5. Pressure impulse tests can be performed to determine what the optimum flow rate is for a particular producing zone. The flow control device is closed and the pressure is acquired at constant intervals. The intelligent control system will analyze and evaluate the pressure buildup versus time and determine what the optimum pressure is for maximum flow and adjust the new flow range based on the test results.

The computers of the control system systems of the present invention, utilize technology, such as, fuzzy logic, and artificial intelligence to develop the downhole systems which can learn and modify its behavior based on events or previous responses to different stimuli.

The control system monitors its environment via an array of sensors. Each sensors monitors a critical production parameter (e.g., pressure, temperature, flow, etc.) and reports it to the master controller for analysis. The control system compares the sensor data with preprogrammed parameters and determines if intervention is necessary. If action is necessary, the control system determines the response based on previous actions and/or a set of basic rules.

Figure 7:
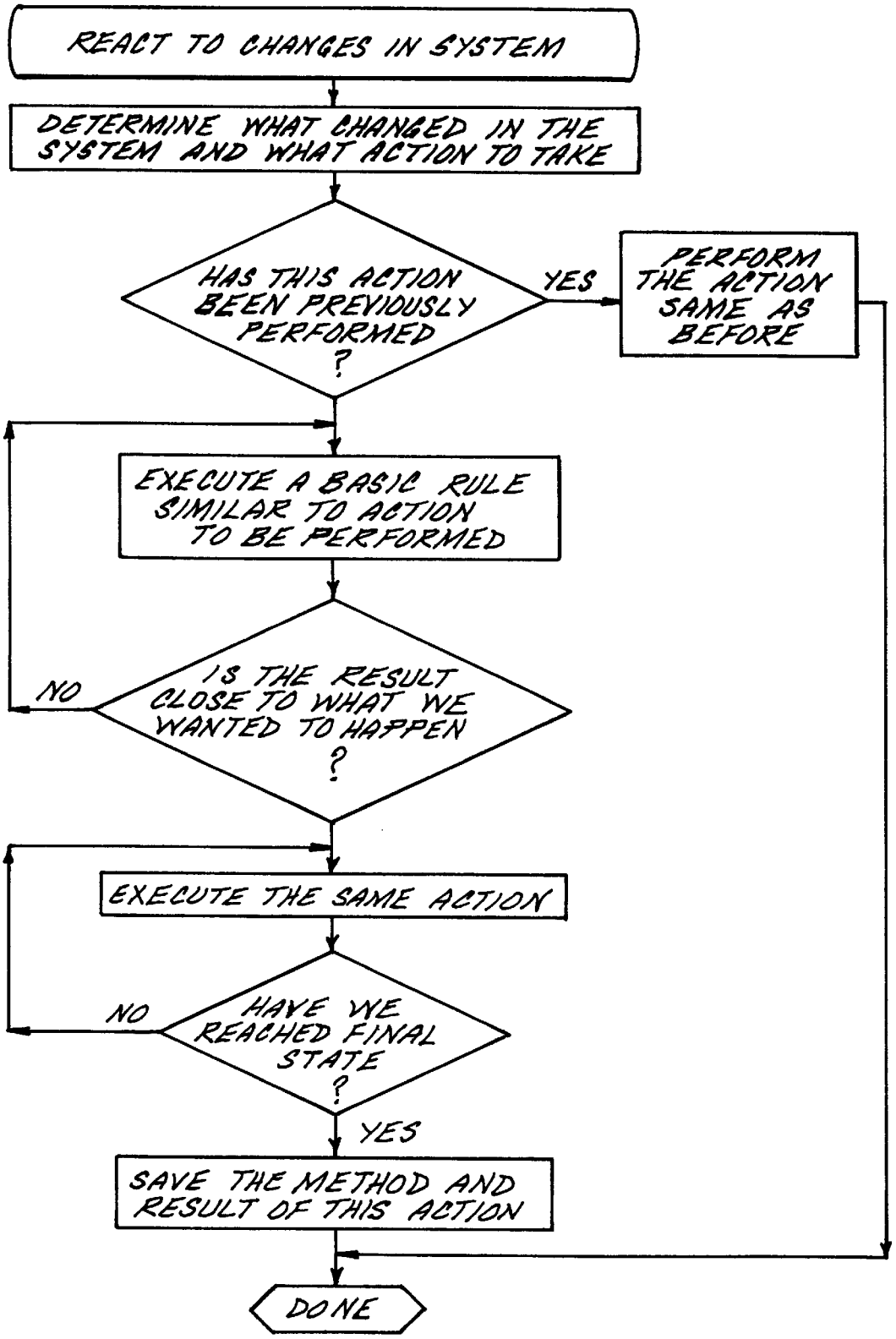
FIG. 7 is a flow chart of a learning process of the control system of the present invention.

Referring to FIG. 7, the control system "learns" by executing a set of actions (commands) in response to changes in the production parameters reported by the sensors. The control system takes action based on predetermined rules and similar situations previously encountered. It then analyzes the sensor feedback to determine what effect that action had on the system. The control system "remembers" the effect of the action on the system for later uses even if the action did not have the desired effect. If a familiar state is encountered, the controller applies the same actions that were previously utilized and analyzes the results. If the actions achieved the desired result, no further action is taken. If the actions do not achieve the desired results, the control system applies its basic rules until the desired system state is achieved and the method is "remembered" for later use.

The control system begins with a simple, general set of actions, e.g., (1) choke the flow if the pressure is below the threshold, (2) open the flow control if the pressure is above the threshold; and (3) check the flow if the water concentration is above the threshold.

As the control system analyzes the results of the basic actions (rules), it will be able to formulate more specific rules. For example, if the pressure in a lateral drops below a programmed threshold. The corresponding control system closes a flow control device and the pressure increases. If the pressure is still below the threshold, the corresponding control system gradually closes the flow control device until the lateral pressure is back in the programmed range. The control system will remember that closing the flow control device a certain amount causes the increase in the pressure.

As described herein, each control system includes, the several plug in, application specific interface modules to collect data from the sensing units, as well as, standard computer system components. A master control system or master processor (computer) is designated or a dedicated master system is provided, and includes: nonvolatile, reprogrammable program memory; nonvolatile data memory; a real time clock; and ruggedized mass storage units.

The interface modules will interface to and control tools under the supervision of the master control system. These modules (systems) will collect data from the tool and make it available to the master control system. They will also execute commands from the master control system.

The communications interface module will facilitate data transfer to/from the master control system to other nodes or uphole to well supervisory systems, such as described in U.S. patent application Ser. No. 08/385,992, U.S. Pat. No. 5,732,776. It will perform all signal conditioning, data transfer, error detection, data flow control, and related data transfer protocol activities. Wireline (fiber optic, copper wire, etc.) and wireless (acoustic, electromagnetic emissions, etc.) communication systems will be utilized depending on well configuration, such being described in U.S. patent application entitled Production Well Telemetry System and Method, filed concurrently herewith, by Paulo Tubel, which is expressly incorporated herein by reference.

As discussed in detail above, the downhole electronics system will control the electromechanical systems, monitor formation and flow parameters, process data acquired in the borehole, and transmit and receive commands and data to and from other modules and the surface systems. The electronics controller is composed of a processor 70, an analog to digital converter 72, analog conditioning hardware 74, digital signal processor 76, communications interface 78, serial bus interface 80, memory 82 (including, e.g., ruggedized mass storage memory, boot ROM, flash program ROM, SRAM and EEPROM) and electromechanical drivers 60.

The microprocessor 70 provides the control and processing capabilities of the system. The processor will control the data acquisition, the data processing, and the evaluation of the data for determination if it is within the proper operating ranges. The processor also has the responsibility of controlling the electromechanical devices 64.

The analog to digital converter 72 transforms the data from the conditioner circuitry into a binary number. That binary number relates to an electrical current or voltage value used to designate a physical parameter acquired from the geological formation, the fluid flow, or status of the electromechanical devices. The analog conditioning hardware processes the signals from the sensors into voltage values that are at the range required by the analog to digital converter.

The digital signal processor 76 provides the capability of exchanging data with the processor to support the evaluation of the acquired downhole information, as well as to encode/decode data for transmitter 52. The processor 70 also provides the control and timing for the drivers 78.

The communication drivers 70 are electronic switches used to control the flow of electrical power to the transmitter. The processor 70 provides the control and timing for the drivers 78.

The serial bus interface 80 allows the processor 70 to interact with other processors. The serial bus 80 allows the surface system 74 to transfer codes and set parameters to the processor 70 to execute its functions downhole.

The electromechanical drivers 60 control the flow of electrical power to the electromechanical devices 64 used for operation of the sliding sleeves, packers, safety valves, plugs and any other fluid control device downhole. The drivers are operated by the processor 70.

The non-volatile memory 82 stores the code commands used by the processor 70 to perform its functions downhole. The memory 82 also holds the variables used by the processor 70 to determine if the acquired parameters are in the proper operating range.

It will be appreciated that downhole valves are used for opening and closing of devices used in the control of fluid flow in the wellbore. Such electromechanical downhole valve devices will be actuated by downhole computer 50 in accordance with the model. As has been discussed, it is a particularly significant feature of this invention that the downhole control system 22 permits automatic control of downhole tools and other downhole electronic control apparatus without requiring an initiation or actuation signal from the surface or from some other external source. This is in distinct contrast to prior art control systems wherein control is either actuated from the surface or is actuated by a downhole control device which requires an actuation signal from the surface as discussed above. It will be appreciated that the novel downhole control system of this invention whereby the control of electromechanical devices and/or electronic control apparatus is accomplished automatically without the requirement for a surface or other external actuation signal can be used separately from the remote well production control scheme shown in FIG. 1.

Controllers 22 in each of zones 1, 2 and N have the ability not only to control the electromechanical devices associated with each of the downhole tools, but also have the ability to control other electronic control apparatus which may be associated with, for example, valving for additional fluid control. The downhole control systems 22 in zones 1, 2 and N further have the ability to communicate with each other so that actions in one zone may be used to effect the actions in another zone. In addition, not only can the downhole computers 50 in each of control systems 22 communicate with each other, but the computers 50 may also have ability to communicate to other downhole computers 50 in other wells, such as described in U.S. patent application Ser. No. 08/385,992, U.S. Pat. No. 5,732,776. For example, the downhole computer system 22 in zone 1 of well 2 in platform 1 may communicate with a downhole control system on platform 2 located in one of the zones or one of the wells associated therewith. Thus, the downhole control system of the present invention permits communication between computers in different wellbores, communication between computers in different zones and communication between computers from one specific zone to a central remote location.

Referring again to FIG. 3, an enlarged view of zones 2 and N from well 2 of platform 1 is shown. As discussed, a plurality of downhole flow sensors 56 and downhole formation evaluation sensors 58 communicate with downhole controller 22. The sensors are permanently located downhole and are positioned in the completion string and/or in the borehole casing. In accordance with still another important feature of this invention, formation evaluation sensors may be incorporated in the completion string such as shown at 58A–C in zone 2; or may be positioned adjacent the borehole casing 78 such as shown at 58D–F in zone N. In the latter case, the formation evaluation sensors are hardwired back to control system 22. The formation evaluation sensors may be of the type described above including density, porosity and resistivity types. These sensors measure formation geology, formation saturation, formation porosity, gas influx, water content, petroleum content and formation chemical elements such as potassium, uranium and thorium. Examples of suitable sensors are described in commonly assigned U.S. Pat. Nos. 5,278,758 (porosity), 5,134,285 (density) and 5,001,675 (electromagnetic resistivity), all of the contents of each patent being incorporated herein by reference.

The production well control system of this invention may utilize a wide variety of conventional as well as novel downhole tools, sensors, valving and the like, e.g., a retrievable sensor gauge side pocket mandrel, subsurface safety valve position and pressure monitoring system, remotely controlled inflation/deflation device with pressure monitoring, remotely actuated downhole tool stop system, remotely controlled fluid/gas control system and remotely controlled variable choke and shut-off valve system, all of which are described in detail in U.S. patent application Ser. No. 08/385,992, U.S. Pat. No. 5,732,776.

While preferred embodiments have been shown and described, modifications and substitutions may be made thereto without departing from the spirit and scope of the invention. Accordingly, it is to be understood that the present invention has been described by way of illustrations and not limitation.

What is claimed is:

1. A downhole computer-based method of controlling a well, comprising:

receiving input from at least one sensor permanently located downhole in the well;

analyzing the input using a permanent downhole controller using at least one internal process model; and generating output to make changes in at least one downhole tool operating variable as suggested by said at least one internal model.

2. The computer-based method according to claim 1, wherein said internal model is self generated.

3. The computer-based method according to claim 2, wherein said internal model is continually updated.

4. The computer-based method according to claim 1 wherein said internal model is further generated and updated by at least one of feed forward or feedback loops.

5. An apparatus for the downhole control of at least one downhole tool in a well comprising:

(a) at least one permanently deployed downhole sensor for sensing a downhole parameter and generating a sensed signal indicative thereof;

(b) at least one downhole control device for controlling at least one downhole tool;

(c) a permanent downhole controller in communication with said downhole sensor and said downhole control device, said downhole controller having a processor and memory for storing an internal model, said processor for executing said internal model and said internal model utilizing said sensed signal to generate a control signal for controlling said downhole control device in accordance with said internal model.

6. The apparatus of claim 5 wherein said internal model comprises a set of rules.

7. The apparatus of claim 5 wherein:

said downhole control device comprises an electromechanical device.

8. The apparatus of claim 7 including:

at least one downhole tool connected to said electromechanical control device.

9. The apparatus of claim 8 wherein:

said electromechanical control device changes the state of said downhole tool in response to input from said downhole electronic controller.

10. The apparatus of claim 8 wherein:

said downhole tool is selected from the group consisting of sliding sleeves, packers, pumps, fluid flow devices and valves.

11. The apparatus of claim 5 wherein:

said downhole sensor comprises a formation evaluation sensor.

12. The apparatus of claim 11 wherein:

said formation evaluation sensor is selected from the group consisting of nuclear, gamma ray, electromagnetics and acoustical sensors.

13. The apparatus of claim 11 wherein:

said formation evaluation sensor measures at least one of formation geology, formation saturation, formation porosity, formation chemical elements, gas influx, water content and petroleum content.

14. The apparatus of claim 5 wherein:

said downhole sensor comprises a flow sensor.

15. The apparatus of claim 5 wherein:

said downhole sensor comprises at least one sensor for measuring temperature, pressure, flow and oil/water ratio.

16. The apparatus of claim 5 wherein:

said downhole sensor includes at least one formation evaluation sensor and at least one flow sensor.

17. The apparatus of claim 5 including:

a plurality of downhole sensors for sensing a plurality of downhole parameters; and a plurality of downhole control devices for controlling a plurality of downhole tools.

18. An apparatus for the downhole control of at least one downhole tool in a well comprising:

a permanent downhole computerized control system which monitors actual downhole parameters and executes control instructions in response to said monitored downhole parameters utilizing an internal model without an external signal or stimulus from the surface.

19. A method for controlling at least one downhole tool in a well including:

sensing at least one downhole parameter using a permanently depolyed downhole sensor to define at least one sensed parameter; and controlling at least one downhole tool in response to the sensed parameter using control signals originating from a permanent downhole controller using an internal model.

20. The method of claim 19 wherein:

said downhole tool is selected from the group consisting of sliding sleeves, packers, pumps, fluid flow devices and valves.

21. The method of claim 19 including:

transmitting at least one of data or control signals from a first location downhole to a second location downhole.

22. The method of claim 19 including:

transmitting at least one of data or control signals from downhole to another downhole location in another well.

* * * * *